United States Patent [19]

Amundson

[11] Patent Number: 4,845,799

[45] Date of Patent: Jul. 11, 1989

[54] LIQUID CONTAINING SCRUBBING BRUSH

[76] Inventor: Arlen G. Amundson, 9736 Shamrock La., Lakeside, Calif. 92040

[21] Appl. No.: 169,962

[22] Filed: Mar. 18, 1988

[51] Int. Cl.[4] ..... A47L 13/10

[52] U.S. Cl. ..... 15/114; 15/201; 15/244.1

[58] Field of Search ..... 15/114, 180, 222, 201, 15/244.1, 244.2, 244.3, 244.4, 104.93, 104.94, 110

[56] References Cited

U.S. PATENT DOCUMENTS

| | | | |
|---|---|---|---|
| D. 280,267 | 8/1985 | Bryant et al. | 15/201 |
| 2,819,482 | 1/1958 | Applegate | 15/110 |
| 3,551,935 | 1/1971 | Gaudry et al. | 15/180 |
| 3,791,746 | 2/1974 | Yearka | 15/222 X |
| 4,168,704 | 9/1979 | Wessel | 15/222 X |

FOREIGN PATENT DOCUMENTS

| | | | |
|---|---|---|---|
| 1134630 | 12/1956 | France | 15/114 |

*Primary Examiner*—Peter Feldman
*Attorney, Agent, or Firm*—Frank D. Gilliam

[57] ABSTRACT

The invention is directed to a soft backed brush with absorbent material positioned on the underside of the brush between the bristles for holding a liquid that can be selectively deposited on the bristles by flexing the back of the brush.

4 Claims, 1 Drawing Sheet

LIQUID CONTAINING SCRUBBING BRUSH

BACKGROUND OF THE INVENTION

The invention is directed to a cleaning tool and more, particularly, to a brush for scrub cleaning in conjunction with a liquid cleaning solution or a like liquid.

For years scrub cleaning has been accomplished by the use of a so called scrub brush. Scrub brushes come in many shapes and sizes. Typically scrub brushes have a rigid wooden back and modernly a rigid plastic back and bristles of a desired length made from natural or synthetic fibers, such as, copra or nylon extend from the back.

In use, it is generally required that a liquid cleaning substance or the like be used with the brush during cleaning. There has been a continuing problem with maintaining the desired amount of the cleaning solution on the surface to be brushed. Generally the liquid is either poured on the surface to be scrubbed with the brush from a separate container, supplied to the brush head from a source of liquid under pressure or continually dipping the brush itself into a supply of the needed liquid.

It has been known for years that sponges either natural or man made from synthetic foams or the like can store a large quantity of liquid. The amount of liquid held or stored depends on the cell size of the sponge material. The problem encountered with the use of sponges is that they are easily destroyed when used for scrubbing or do not have the required abrasiveness to do the required scrub cleaning.

There has been a long standing need for a simple inexpensive scrub brush that can contain a limited quantity of a liquid solution for scrub cleaning of small areas without the need to constantly supply a cleaning solution from a bucket or the like by pouring on the area desired to be scrubbed or the continual dipping of the brush into a container of the liquid cleaning solution and then splashing the liquid carried by the brush onto the surface to be scrubbed.

SUMMARY OF THE INVENTION

The invention is directed to a combination bristle brush and sponge. The brush portion preferrably includes a flexible back although a semi-rigid back could be employed and spaced apart tufts of bristles. the bristles are generally stiff but could be soft for some cleaning tasks. A liquid absorbing sponge or foam material is positioned between the tufts of bristles and extends from the inside of the brush back toward the bristle tips. The sponge is held in place by a plurality of locking surfaces carried by the bristle-to-back mounting means. The sponge can be cast or formed in place or cut to size and forced down and around the tufts of bristles against the inside of the back of the brush and held in place by the locking means.

When in use the combination brush and sponge is dipped into a suitable cleaning liquid where the sponge absorbs a quantity of the liquid and when removed maintains that storage until it is released by flexing the back of the brush or the pressing of the brush against an object. In this manner a substantial cleaning job can be performed without again dipping the combination sponge brush into the cleaning liquid.

It is an object of this invention to provide a scrub brush of the manual type for cleaning substantially small areas which can hold sufficient liquid cleaning solution to clean those small areas without continually dipping the scrub brush into a container of the liquid cleaning solution during the cleaning task.

It is a further object of this invention to provide a scrub brush that eliminates or reduces some of the manual labor required to perform the same cleaning task using a conventional scrub brush.

Other objects, advantages and novel features will be apparent from the following detailed description when read in conjunction with the appended claims and attached drawings.

DESCRIPTION OF THE PREFERRED EMBODIMENT

Figure 1:
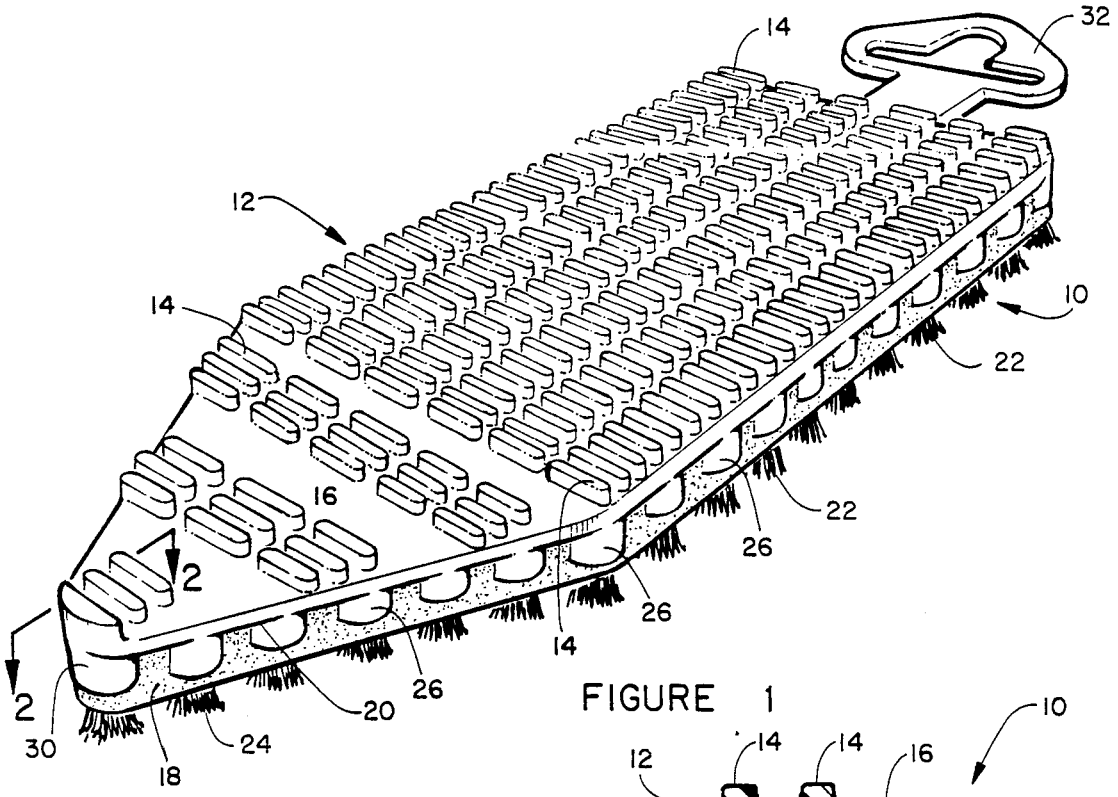
FIG. 1 is a top perspective showing of the scrub brush of the invention.

Referring now to the various drawing Figures, FIG. 1 depicts a top perspective view of the scrub brush 10 of the present invention. A back 12 is formed with a plurality of extending spaced apart ribs 14 which provide required mass to the back of the brush and yet allow the main back portion 16 to be able to flex longitudinally or horizontally for brushing irregular surfaces and for selectively dispensing a cleaning liquid stored within a sponge or foam portion 18. The back portion 12 is generally formed of injection molded or cast formed plastic or the like. Plastic should not be considered a limitation for the construction of the back 12 of the brush as the brush can be constructed of any material suitable for the intended purpose.

The sponge or foam portion 18 can be formed from any suitable natural sponge or synthetic foam material that is commonly used to make "sponge" material. The sponge can be of the closed, open or intermediate cell type depending on the brush requirements. Generally the cell size will be chosen that holds the maximum amount of any given liquid cleaning solution. The sponge or foam portion 18 extends from the inside 20 of the brush back 12 to a location intermediate the length of the tufts of the bristles 22. This allows for normal bristle action without interference from the sponge or foam portion. The sponge or foam should terminate between one quarter of an inch and one eighth of an inch from the distal ends 24 of the bristles. The spacing allows for bristle wear without interference with the sponge or foam for substantially the normal life expectancy of the bristles. The bristles are constructed of material normally used for scrub brush bristles. The tufts of bristles are cast or molded in place in the brush back 12 by well known conventional methods.

A plurality of bristle tuft holding pedestals 26 extend from the inside of the brush back outwardly. As shown in the various Figures, the pedestals are spaced apart to provide an open area to receive the sponge or foam portion 18.

Figure 2:
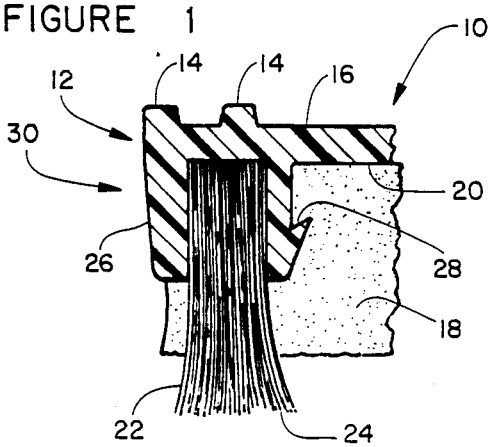
FIG. 2 is a cutaway showing of FIG. 1 taken along line 2—2.
Figure 3:
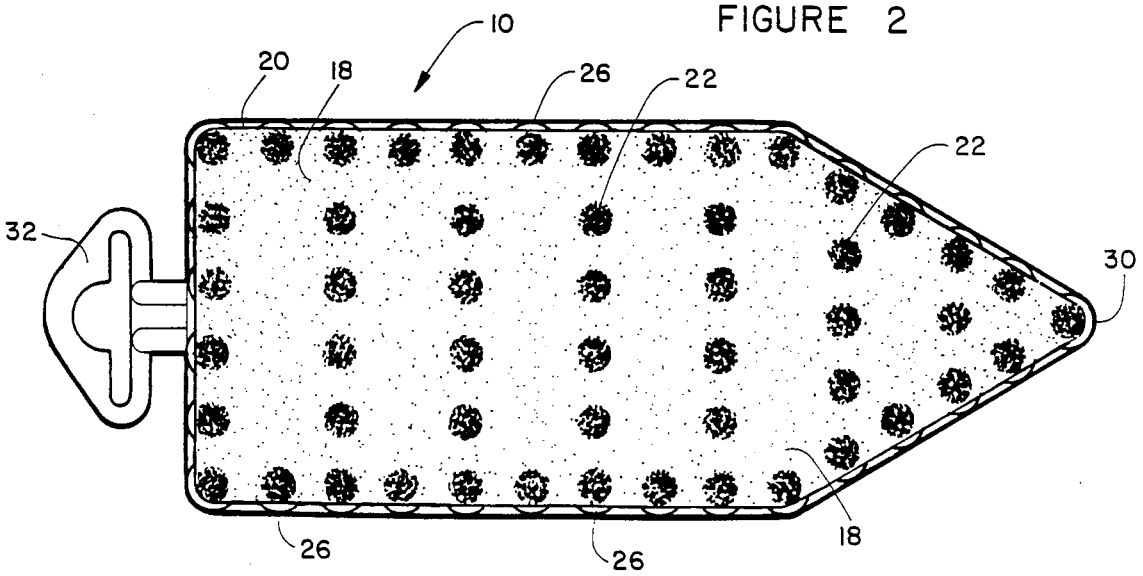
FIG. 3 is a bottom plan showing of the scrub brush of FIG. 1.

As can be seen in FIG. 2, the pedestals 26 include a notch 28 with a downward extending inner hook surface which prevents the sponge or foam portion from becoming disengaged from the brush when positioned thereon by foaming in place, casting thereon forcing a die cut sponge or foam thereover or placed thereon by any other known means.

The brush 10 is shown as being pointed at one end 30 and provided with a hanger 32 at the other end. It should be understood that the embodiment shown is only for ease of explanation and not by way of limitation. The brush can take any shape commonly used or desired.

In use, the brush is immersed into a container containing a liquid for use in cleaning and while immersed therein flexed along its longitudinally dimension or length or transverse dimension or width to aid in absorbing the cleaning liquid in the sponge or foam portion of the brush. The brush is allowed to soak up the liquid and then is removed to perform the brush cleaning task. While in normal use if liquid is required the brush back is flexed an amount required to deposit a desired quantity of liquid on the area of the cleaning task. This procedure is repeated until the cleaning task is completed or more liquid is required. If more liquid is required, the process of immersing the brush into the cleaning liquid is repeated as required.

While there has been shown and described what is considered to be the preferred embodiment of the present invention, it will be obvious to those of ordinary skill in the art that various changes and modifications may be made therein without departing from the spirit of the invention as defined in the appended claims.

What is claimed is:

1. A liquid containing scrub brush comprising:

a back portion;

a plurality of bristles positioned in a plurality of spaced apart tufts carried by said back portion;

a liquid absorbing material positioned in the spaces between said plurality of spaced apart bristles; and locking means for locking said tufts to said back portion, said tufts are attached to said back portion by pedestals formed as integral portion of said back portion and said locking means comprises absorbing material hooking means carried by said pedestals;

said tufts of bristles extending a first distance from said back portion and said liquid absorbing material extending a second distance from said back portion, said first distance being greater than said second distance.

2. The inventions as defined in claim 1 wherein said back portion is flexible.

3. The invention as defined in claim 1 wherein said back portion is rigid.

4. The invention as defined in claim 1 wherein said liquid absorbing material includes apertures therethrough sized to fit around said tufts and fill said spaces.

* * * * *